US005294231A

United States Patent [19]

Palacin

[11] Patent Number: 5,294,231

[45] Date of Patent: Mar. 15, 1994

[54] DYEING PROCESS

[75] Inventor: Francis Palacin, Riedisheim, France

[73] Assignee: Sandoz Ltd., Basle, Switzerland

[21] Appl. No.: 988,628

[22] Filed: Dec. 10, 1992

[30] Foreign Application Priority Data

Dec. 14, 1991 [DE] Fed. Rep. of Germany ..... 4141301

[51] Int. Cl.[5] ..... D06P 3/82

[52] U.S. Cl. ..... 8/532; 8/531; 8/543; 8/571; 8/572; 8/638

[58] Field of Search ..... 8/571, 572, 573, 691, 8/638

[56] References Cited

U.S. PATENT DOCUMENTS

| | | | |
|---|---|---|---|
| 2,024,502 | 12/1935 | Berthold | 8/571 |
| 3,008,858 | 11/1961 | Blake et al. | 8/571 |
| 3,096,141 | 7/1963 | Bennett et al. | 8/571 |
| 3,148,936 | 9/1964 | Turbak | 8/571 |
| 4,012,378 | 3/1977 | Crabtree | 8/543 |
| 4,752,299 | 6/1988 | Annen et al. | 8/638 |

FOREIGN PATENT DOCUMENTS 48-20916 6/1973 Japan .

*Primary Examiner*—Paul Lieberman
*Assistant Examiner*—Necholus Ogden
*Attorney, Agent, or Firm*—Robert S. Honor; Richard E. Vila; Andrew N. Parfomak

[57] ABSTRACT

A process for dyeing a mixed fiber substrate with at least one disperse dye and at least one metal complex dye selected from direct dyes and reactive dyes characterized in that dyeing is carried out in the presence of a compound of formula I

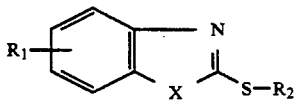

(I)

in which
X is —S—, —O—, or —NH—;
$R_1$ is hydrogen, —OH or $C_{1-4}$alkyl; and
$R_2$ is hydrogen, $NH_4$ or an alkali metal (such as Na or K).

10 Claims, No Drawings

DYEING PROCESS

The invention relates to a process for dyeing a mixed fibre fabric or material, in which one type of fibre is dyeable with a disperse dye and the other type of fibre is dyeable with a direct or reactive dye.

Often such direct or reactive dyes are metal containing and these metal containing dyes have a negative effect on the disperse dye dyeing in the mixed fabric. Free metal, that is not bound to the direct or reactive dye molecule, can interfere with the disperse dye. This results in poor reproducibility of the disperse dye fibre dyeing.

It has been found on the one hand that complexing agents (to remove free metal ions) such as ethylenediamine acetic acid (EDTA) [which is used for reducing the hardness of water] is too strong a complexing agent and can destroy the direct or reactive dye. On the other hand there are complexing agents such as polyphosphate which are not powerful enough to inactivate all the free metal ions.

According to the invention, there is provided a process for dyeing a mixed fibre substrate with at least one disperse dye and at least one metal complex dye selected from direct dyes and reactive dyes characterized in that dyeing is carried out in the presence of a compound of formula I (I)

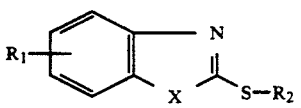

in which

X is —S—, —O—, or —NH—;

$R_1$ is hydrogen, —OH or $C_{1-4}$alkyl; and $R_2$ is hydrogen, $NH_4$ or an alkali metal (such as Na or K).

Preferably a process according to the invention is a single bath process.

The compounds of formula I usually act as complexing agents in a process according to the invention to inactivate any free metal ions associated with the direct or reactive dye or dyes.

Preferred compounds of formula I are 2-mercaptobenzthiazole, 2-mercaptobenzoxazole and 2-mercaptobenzimidazole and derivatives thereof (e.g. their salts). More preferred is 2-mercaptobenzthiazole.

Preferably the amount of compound of formula I that is added is 1:1 to 20:1 based on the amount of free metal present based on a mol:mol ratio.

High dyeing temperatures, for example over 100° C. (which is usual for dyeing polyester-cellulose or polyamide-cellulose mixed fibres) can cause the direct or reactive metal complex dyes to be destroyed and so release free metal ions. Even when the metal complexes are stable at higher temperatures, free metal ions can be detected in the dyebath. These ions are not in complex form. The term "free metal ions" therefore includes all free metal ions associated with the metal dyes as well as any free metal ions that are released during the dyeing process.

Preferably the amount of the compound of formula I in a process according to the invention is from 0.001 g/l to 1 g/l, more preferably 0.005 g/l to 0.5 g/l.

The concentration of free metal can be determined by known methods. One such method is by visually comparing the negative effect on a disperse dye dyeing of direct or reactive metal containing dye with the same dyeing under the same conditions using a variety of copper sulphate solutions of differing concentrations. The amount of free ion can be determined by the amount of copper in the copper sulphate solution that causes the same negative effect as that of the metal-containing dye. (Copper sulphate can also be substituted by other known metal salt solutions). The concentration of free metal can also be determined by atomic absorption spectroscopy (such as described in "Flame Emission and Atomic Spectroscopy, John R. Dean, I, Chapter 1 (III) the contents of which are incorporated herein by reference). A Perkin Elmer Spectrometer is used.

The disperse dyes that are preferably used in a process according to the invention are those normally used to dye polyester. More preferably the disperse dyes are those having values from 1–4 inclusive measured in the modified test method ISO Z02 (where the modification is that dyeing is carried out in the presence of metal salt at 130° C. instead of 98° C.).

The reactive dyes used in a process according to the invention are preferably any water soluble metal complex dye having at least one fibre reactive group present that is capable of reacting with an —OH group on cellulose.

The direct dyes that can be used in a process according to the invention are preferably metal complexes that are used for dyeing wool or cellulose. These dyes are well known from the Color Index.

Preferred metal-complex direct or reactive dyes are copper complex dyes.

Most preferred reactive dyes are selected from

| | | |
|---|---|---|
| CI Reactive Blue 209 | CI Reactive Blue 79 | CI Reactive Red 171 |
| CI Reactive Blue 113 | CI Reactive Blue 116 | CI Reactive Red 55 |
| CI Reactive Blue 52 | CI Reactive Blue 41 | CI Reactive Violet 6 |
| CI Reactive Blue 120 | CI Reactive Green 15 | CI Reactive Violet 33 |

Most preferred direct dyes are selected from:

| | | |
|---|---|---|
| C.I. Direct Yellow 98 | C.I. Direct Blue 86 | C.I. Direct Green 69 |
| C.I. Direct Red 83:1 | C.I. Direct Blue 90 | C.I. Direct Black 62 |
| C.I. Direct Red 207 | C.I. Direct Blue 199 | C.I. Direct Black 117 |
| C.I. Direct Violet 47 | C.I. Direct Blue 250 | C.I. Direct Black 118 |
| C.I. Direct Violet 66 | C.I. Direct Brown 113 | |
| C.I. Direct Blue 77 | C.I. Direct Brown 240 | |

Most preferred disperse dyes are selected from:

| | | |
|---|---|---|
| C.I. Disperse Yellow 42 | C.I. Disperse Blue 56 | C.I. Disperse Blue 79 |
| C.I. Disperse Red 53 | C.I. Disperse Blue 73 | C.I. Disperse Blue 79:1 |
| C.I. Disperse Red 60 | C.I. Disperse Blue 75 | C.I. Disperse Blue 87 |
| C.I. Disperse Violet 27 | C.I. Disperse Blue 77 | |

Preferred mixed fibre substrates that can be dyed with a process according to the invention are polyester/cellulose and polyamide/cellulose, more preferably polyester/cellulose mixed fibre substrates. Either fibre of the mixed fibre substrate can be dyed first.

Dyeing is preferably carried out in a single step single bath process or a two step single bath process.

Dyeing can be carried out by known methods.

Additives usual for dyeing with direct or reactive dyes and for dyeing with disperse dyes can be added to the bath (e.g. dispersing agents, preferably anionic dispersing agents, NaCl and/or Glauber salt and, where reactive dyes are used in a process according to the invention, an alkali fixing medium, such as sodium or potassium carbonate, sodium or potassium bicarbonate, sodium or potassium silicate, sodium or potassium borate or sodium and potassium phosphate or mixtures thereof.

Preferably dyeing with the disperse dyes (e.g. for the polyester fibres of a mixed fibre substrate) is performed at pH of 3–9 more preferably 4–6, most preferably 4–5.5 and at a temperature of 125°–135° C. for 15–45 minutes. Dyeing with direct or reactive dye, preferably for the cellulose fibres of the mixed fibres, is performed at 60°–80° C. for 10–45 minutes at a pH of 3–9.

A process according to the invention is particularly useful for dyeing of polyester/cellulose mixed fibre substrates with disperse dyes and direct metal complex dyes, where the dyeing temperature is preferably 60°–135° C.

After dyeing in a process according to the invention, conventional washing and drying steps may be employed.

Dyeings made by a process according to the invention have good fastness properties and enable the polyester fibre to maintain the disperse dye nuance (no negative influence on the nuance of the disperse dye).

The invention will now be illustrated by the following examples in which all parts and percentages are by weight and all temperatures are in °C.

EXAMPLE 1

5 g of a polyester-cotton fabric are introduced at 60° C. into a dyeing bath (1000 cc) containing 1.0 g/l of C.I. Direct Brown 240.

0.2 g/l of the commercial disperse black dye mixture comprising 20 parts of CI Disperse Blue 79:1

12 parts of CI Disperse Orange 30

6 parts of CI Disperse Red 54 and CI Disperse Violet 93:1, 10 g/l Glauber salt 0.35 g/l polyarylether sulphonate (commercially available as Lyocol RDN);

0.01 g/l of 2-mercaptobenzthiazole, 0.10 g/l sodium citrate and sufficient formic acid to bring the pH to 5.5.

The temperature is raised over 20 minutes to 130° C. and further dyeing is carried out at this temperature for 15 minutes. Over 20 minutes thereafter, the dyeing bath is cooled to 60° C. and then the bath is drained.

The nuance of the polyester fibres is the same as a dyeing made with the same disperse dye in the absence of direct dye. Further, when the dyeing is repeated with no 2-mercaptobenzthiazole in the bath, the nuance of the polyester fibres is very negatively affected compared to the standard dyeing (without direct dye present).

Example 1 can be repeated using 0.01 g/l of 2-mercaptobenzoxazole or 2-mercaptobenzimidazole in place of the 2-mercaptobenzthiazole.

EXAMPLE 2

Example 1 is repeated using, instead of the bath of Example 1, a bath containing 1 g/l of C.I. Direct Brown 240

1 g/l of a dye mixture containing 20 parts of CI Disperse Blue 79

12 parts of CI Disperse Orange 30 and 6 parts of CI Disperse Red 54

10 g/l Glauber salt 0.35 g/l of a polyarylethersulphonate (a dispersing agent)

0.01 g/l of 2-mercaptobenzthiazole and 0.12 g/l of citric acid monohydrate

Similar results are found to those of Example 1.

EXAMPLE 3

5 g of a mixed fibre fabric of polyester and spun-rayon are introduced into a dyeing bath at 60° C. (100 ml) containing 0.2 g/l CI Disperse Blue 79:1

1.0 g/l CI Direct Brown 240

10 g/l Glauber salt 0.35 g/l of a polyarylether sulphonate 0.005 g/l of 2-mercaptobenzthiazole and 0.12 g/l of citric acid monohydrate.

The pH of the bath is 5.5. The temperature is then brought over 30 minutes to 130° C. and is further dyed at this temperature for 45 minutes.

The dyeing bath is then cooled to 60° C. over 20 minutes and then the bath is drained.

The nuance of the polyester fibres is the same as a similar dyeing carried out in the absence of direct dye. A similar dyeing without 2-mercaptobenzothiazole (with direct dye) causes the nuance to be very strongly negatively affected compared to the dyeing with no direct dye.

I claim:

1. A process for dyeing a polyester/cellulose or polyamide/cellulose substrate with at least one disperse dye and at least one metal complex dye selected from direct dyes and reactive dyes, characterized in that, dyeing is carried out in the presence of a compound of formula I in the dye bath

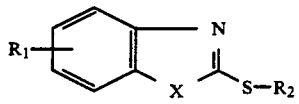

(I)

in which

X is —S—, —O—, or —NH—;

$R_1$ is hydrogen, —OH, or $C_{1-4}$alkyl; and $R_2$ is hydrogen, $NH_4$, or an alkali metal.

2. A process according to claim 1 which is a single bath process.

3. A process according to claim 1 in which the compounds of formula I are selected from the group consisting of: 2-mercaptobenzthiazole, 2-mercaptobenzimidazole, 2-mercaptobenzoxazole and derivatives thereof.

4. A process according to claim 1 in which the amount of compound of formula I added is 1:1 to 20:1 based on the amount of free metal present based on a mol:mol ratio.

5. A process according to claim 1 in which the amount of compound of formula I present is from 0.001 g/l to 1 g/l inclusive.

6. A process according to claim 1 in which disperse dyeing is carried out at temperatures of 125°-135° C. and from the direct or reactive dye dyeing is carried out at 60°-80° C.

7. A polyester/cellulose or polyamide/cellulose substrate when dyed by a process according to claim 1.

8. A process according to claim 1 wherein the disperse dye is selected from the group consisting of:

C.I. Disperse Yellow 42, C.I. Disperse Red 53, C.I. Disperse Red 60, C.I. Disperse Violet 27, C.I. Disperse Blue 56, C.I. Disperse Blue 73, C.I. Disperse Blue 75, C.I. Disperse Blue 77, C.I. Disperse Blue 79, C.I. Disperse Blue 79:1, and C.I. Disperse Blue 87.

9. A process according to claim 1 wherein the metal complex dye is a direct dye are selected from the group consisting of:

C.I. Disperse Yellow 98, C.I. Direct Red 83:1, C.I. Direct Red 207, C.I. Direct Violet 47, C.I. Direct Violet 66, C.I. Direct Blue 77, C.I. Direct Blue 86, C.I. Direct Blue 90, C.I. Direct Blue 199, C.I. Direct Blue 250, C.I. Direct Brown 113, C.I. Direct Brown 240, C.I. Direct Green 69, C.I. Direct Black 62, C.I. Direct black 117, and C.I. Direct Black 118.

10. A process according to claim 1 wherein the metal complex dye is a reactive dye are selected from the group consisting of:

C.I. Reactive Blue 209, C.I. Reactive Blue 113, C.I. Reactive Blue 52, C.I. Reactive Blue 120, C.I. Reactive Blue 79, C.I. Reactive Blue 116, C.I. Reactive Green 15, C.I. Reactive Red 171, C.I. Reactive Red 55, C.I. Reactive Violet 6, and C.I. Reactive Violet 33.

* * * * *